United States Patent [19]

Szucsanyi

[11] Patent Number: 5,000,146

[45] Date of Patent: Mar. 19, 1991

[54] MOTOR BRAKE FOR COMMERCIAL VEHICLES

[75] Inventor: Karoly Szucsanyi, Emskirchen, Fed. Rep. of Germany

[73] Assignee: MAN Nutzfahrzeuge Aktiengesellschaft, Munich, Fed. Rep. of Germany

[21] Appl. No.: 477,596

[22] Filed: Feb. 9, 1990

[30] Foreign Application Priority Data

Feb. 15, 1989 [DE] Fed. Rep. of Germany ..... 3904497

[51] Int. Cl.[5] ..... F02D 13/04

[52] U.S. Cl. ..... 123/321; 123/198 DB

[58] Field of Search ..... 123/321, 323, 325, 510, 123/347, 198 DB

[56] References Cited

U.S. PATENT DOCUMENTS

| | | | |
|---|---|---|---|
| 3,367,312 | 2/1968 | Jonsson | 123/321 |
| 3,547,087 | 12/1970 | Siegler | 123/321 |
| 4,158,348 | 6/1979 | Mason et al. | 123/321 |
| 4,398,510 | 8/1983 | Custer | 123/321 X |
| 4,697,558 | 10/1987 | Meneely | 123/321 |
| 4,711,210 | 12/1987 | Reichenbach | 123/321 |

*Primary Examiner*—Willis R. Wolfe

*Attorney, Agent, or Firm*—Robert W. Becker

[57] ABSTRACT

A decompression brake for commercial vehicles, including a hydraulic mechanism that during the compression stroke, in the zone of the ignition-upper dead center position, holds the exhaust valve of the Diesel engine slightly open. The hydraulic mechanism is formed by: an actuating cylinder that controls the exhaust valve and includes an actuating piston, a control line, and a transmitter cylinder that has a transmitting piston. To provide a simpler construction of the hydraulic system, the injection pump that is inherent to the engine is itself used as a controlled transmitter cylinder and piston.

7 Claims, 1 Drawing Sheet

MOTOR BRAKE FOR COMMERCIAL VEHICLES

BACKGROUND OF THE INVENTION

The present invention relates to a motor brake of a Diesel engine for a commercial vehicle, including a hydraulic mechanism that during the compression stroke, in the zone of the ignition-upper dead center position, holds the exhaust valve of the engine slightly open, with the hydraulic mechanism being formed by: an actuating cylinder that controls the exhaust valve and includes an actuating piston, a control line, and a transmitter cylinder that has a transmitter piston.

The so-called exhaust brake is known as a motor braking system. By closing a shutoff mechanism in the exhaust system, the exhaust work of the piston is increased bY building up a counterpressure in the exhaust manifold, with the piston having to exhaust against this counterpressure.

Motor brake systems are also known that make use of the compression work of the compression stroke, via discharge or exhaust in the zone of the ignition-upper dead center position, to effect braking (decompression braking). This is generally effected by a slight opening of the exhaust valve (however, it can also be effected via an additional small valve).

It is, of course, also possible to combine both brake systems.

The most frequently used decompression brake is the Jacobs brake. With this brake (preferably with engines having pump nozzles-injection systems) by placing a hydraulic unit on the cylinder head the pump stroke is utilized to slightly open the exhaust valve in the ignition-upper dead center position. The arrangement itself thus comprises a (separate) hydraulic system having a transmitter piston, and is driven by cams of the pump nozzle drive (or by the valve cams or push rods of the independent engine cylinder). The engine oil is used as hydraulic fluid. The opening and closing of the exhaust valve is controlled via electronic mechanisms and solenoid valves.

This additional hydraulic system forms a very complicated mechanism. In addition, it requires additional structural measures because of the housing, which contains the control mechanisms and the elements, and is placed upon the cylinder head. Thus, the drawback of this known motor brake is the expensive and complicated additional component.

It is therefore an object of the present invention to provide a decompression brake of the aforementioned general type that has a considerably more straightforward construction and is hence cheaper, in other words, a decompression brake that to the extent possible can be embodied without significant structural alteration. In addition, this decompression brake should be capable of being easily combined with the conventional exhaust brake.

BRIEF DESCRIPTION OF THE DRAWING

These and other objects and advantages of the present invention will appear more clearly from the following specification in conjunction with the accompanying schematic drawing, in which.

FIG. illustrates one exemplary embodiment of the inventive motor brake system.

SUMMARY OF THE INVENTION

The motor brake of the present invention is characterized primarily in that the injection pump, which is inherent to the engine, is itself used as a controlled transmitter cylinder and piston.

By using the injection pump as the transmitter cylinder, a hydraulic mechanism is provided that has a very straightforward construction, and with which the number of additional control devices or members is low. In addition, these control members, such as the actuating piston, can be made smaller due to the high pressure that prevails.

Further specific features of the present invention will be described in detail subsequently.

DESCRIPTION OF PREFERRED EMBODIMENTS

Figure 1:
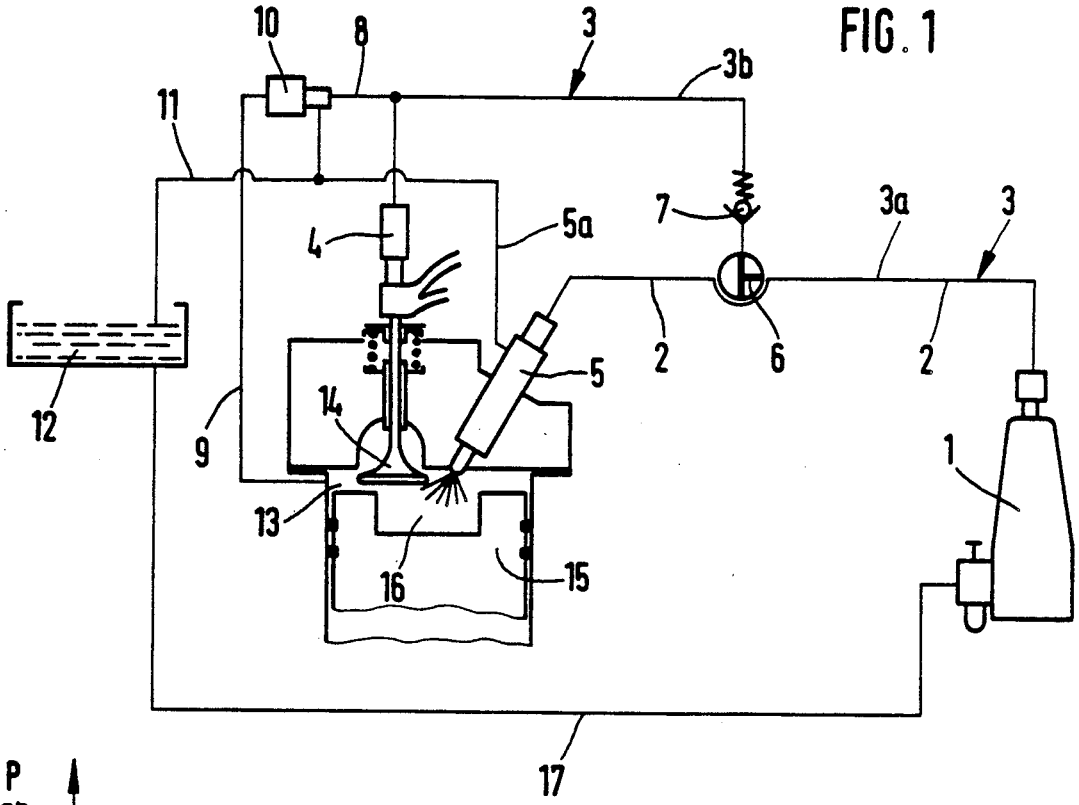

Referring now to the drawing in detail, FIG. 1 schematically illustrates the inventive motor brake system (the decompression brake). Close to the upper dead center position (in the zone of the ignition-upper dead center position) of the compression stroke, the exhaust valve 14 of a direct injection Diesel engine (including engine cylinder 13, engine piston 15, and piston combustion chamber 16) is opened slightly, so that the energy that is absorbed by the engine during the compression stroke is not returned to the engine during the expansion stroke.

Opening of the exhaust valve 14 (i.e. the exhaust valve mechanisms) is effected via a hydraulic mechanism, which comprises an actuating cylinder that controls the exhaust valve 14 and includes the actuating piston 4 (acts upon the tappet of the rocket arm), a control line 3, as well as a transmitter cylinder with a transmitter piston 1. Pursuant to the present invention, the hydraulic actuation of the actuating piston 4 is produced by the injection pump elements in the form of the transmitter piston 1. The Diesel fuel is used as hydraulic fluid. The use of the injection pump itself that is inherent to the engine as the controlled transmitter cylinder or piston 1 (master cylinder) is advantageous for the reason that the beginning of delivery thereof prior to the end of the compression stroke starts at 15° to 30° crank angle prior to the upper dead center position, wherever the opening of the exhaust valve 14 is desired.

The delivery pressure that can be achieved with the injection pump 1 is high, being up to 1000 bar, and can thus exert a sufficient opening force upon the exhaust valve 14. Due to the high pressure level in the actuating cylinder, the actuating piston 4 has a small diameter (approximately 10 mm). The delivery volume (stroke volume) per operating cycle of the injection pump 1 is adequate to provide to the actuating piston 4 a maximum stroke of approximately 2.5 mm.

Disposed in the injection line 2 that lies between the injection pump 1 and the injection nozzle 5 is a diverter 6. During operation of the engine, this diverter 6 allows fuel to flow in an unobstructed manner to the injection nozzle 5, and during the braking operation allows fuel to flow to the actuating cylinder or piston 4. In the latter situation, the first part of the injection line 2 is thus converted to the control line 3, or more precisely to the portion **3*a* thereof. The rest of the control line 3 is formed by an additional line 3*b* (proceeding from the diverter 6 and leading to the actuating cylinder 4). Provided in this line 3*b*, after the diverter 6, is a check valve 7. This check valve prevents the fuel from flowing backwards, and hence prevents disruption in the injection line 2. The exhaust valve 14 thus remains open by means of the actuating piston 4** of the hydraulic system. Under certain circumstances, the check valve that is inherent to the injection pump could also be adequate.

A valve 10 is disposed in a branch line 8 of the control line 3. This valve 10 is acted upon by the pressure of the engine cylinder 3 via a pressure line 9. The engine/cylinder pressure can be influenced by an additional exhaust brake system (exhaust valve) that improves the braking capacity.

The valve 10, which is controlled by the pressure of the engine cylinder 13, allows the exhaust valve 14 to close when the pressure in the engine cylinder 13 drops below a certain level. The back flow of the fuel out of the operating or actuating cylinder 4 (via a discharge line 11) is in this connection prevented for just as long by the valve 10. The closing of the exhaust valve 14 is initiated when the exhaust/cylinder pressure drops below the desired minimum (in the illustrated embodiment, approximately 5.7 bar).

The discharge line 11 (vent line) of the valve 10 is connected to the vent line 5*a* of the injection nozzle 5. The vent lines 5*a*, 11 lead to a reservoir 12 for hydraulic fluid. The injection pump 11 is also supplied from this reservoir 12 via a line 17.

Figure 2:
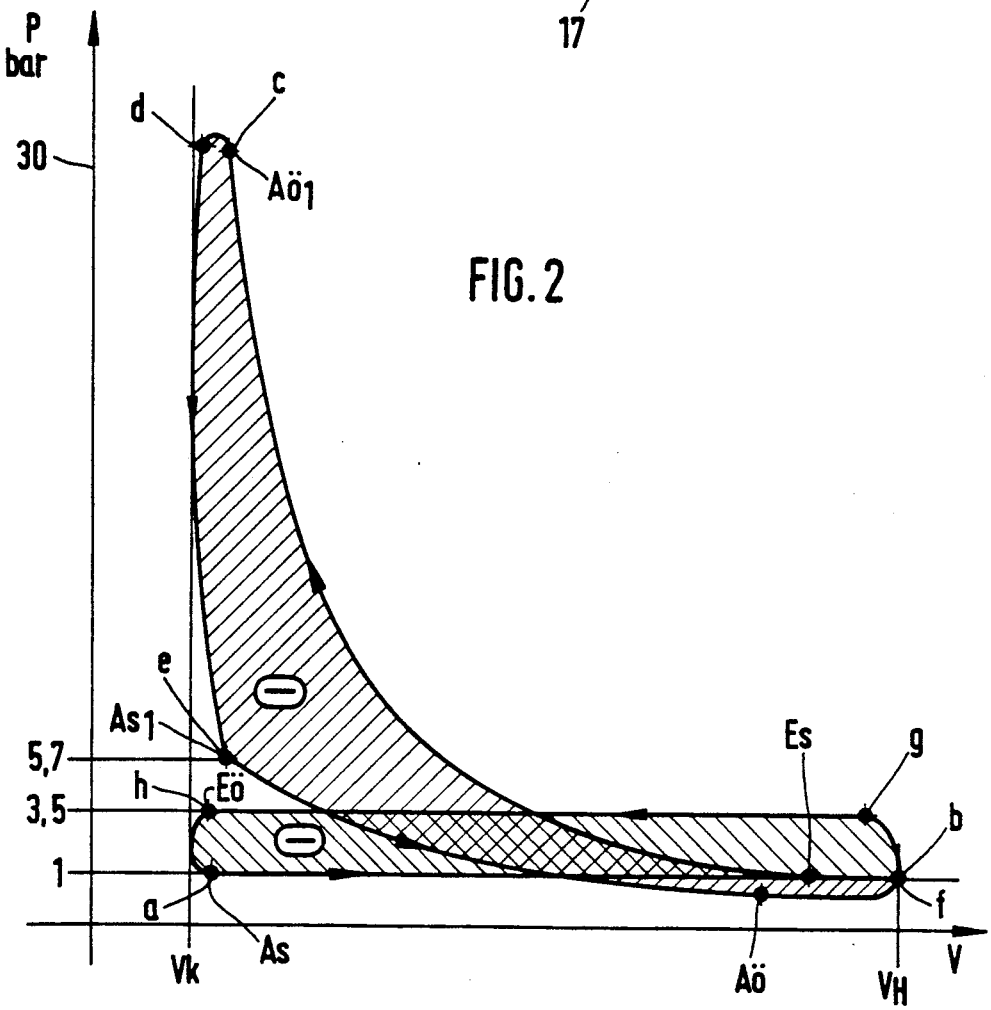
FIG. 2 is a graph showing the operation of a combined compression and exhaust brake cycle.

FIG. 2 is a graph (p/V graph) showing the operation of a combined compression and exhaust braking cycle. The cylinder pressure P is plotted on the ordinate, and the stroke volume is plotted on the abscissa. ($V_H$ refers to the stroke volume, and $V_K$ refers to the compression volume).

After the intake process a-b, the intake valve $E_s$ closes and the compression is effected until the exhaust valve 14 opens (c, $A_{\bar{s}1}$) via the actuating piston 4 of the hydraulic system, generally prior to or possibly even after the top dead center position (the latter situation where there is a slight gas pedal pressure, i.e. less than full delivery of the fuel quantity). The exhaust valve opening pressure depends, among other things, upon the compression ratio of the engine the delivery start of the injection pump, and possible manifold pressure. Without taking into consideration possible manifold pressure, this pressure, at full fuel quantity, is set in the illustrated embodiment at approximately 30 bar.

In the interest of an acceptable braking power, this point is disposed approximately 15° to 30° crank angle ahead of the upper dead center position. After the exhaust valve 14 has opened, the pressure in the engine cylinder (point d) drops to the pressure (e, $A_{s1}$) determined by the valve 10. The opening pressure of the valve 10 is expediently such that it is slightly greater than the pressure in the exhaust manifold. Due to the closed exhaust brake valve the pressure in this situation is between 3 and 4.5 bar. The expansion starts at the point "e" and continues until the exhaust valve is again opened by the normal load change control (f). The final expansion pressure continues to less than atmospheric pressure. The load change f-g-h-a-b is, as known, characterized by high exhaust counterpressure.

As can be seen, the high and low pressure operating surfaces formed by the changes in condition are negative, i.e. dissipation of work. The size of the negative high pressure operating curve depends upon the pressure built up behind the operating cylinder (actuating cylinder 4). If the pressure is less than that required to open the exhaust valve 14 immediately after start of delivery, i.e. for opening prior to the upper dead center position, the exhaust valve 14 is opened after the upper dead center position during the expansion at a decreasing pressure. The negative high pressure curve is thereby shortened. Where there is no more delivery, this curve even becomes zero. Consequently, when "giving gas", this operating surface can theoretically be controlled in conformity with the driving or braking conditions.

The present invention is, of course, in no way restricted to the specific disclosure of the specification and drawing, but also encompasses any modifications within the scope of the appended claims.

What I claim is:

1. In a motor brake of a Diesel engine for a commercial vehicle, including a hydraulic mechanism that during the compression stroke, in the zone of the ignition-upper dead center position, holds the exhaust valve of the engine slightly open, with said hydraulic mechanism being formed by: an actuating cylinder that controls said exhaust valve and includes an actuating piston, a control line, and a transmitter cylinder that has a transmitter piston, the improvement wherein:

an injection pump that is inherent to said engine is itself used as a controlled transmitter cylinder and piston;

an injection nozzle is provided;

said control line includes: a first portion that forms an injection line between said injection pump and said injection nozzle, and a second remaining portion that leads to said actuating piston from a diverter that is disposed in said injection line for connecting said second portion thereto; and a check valve is disposed in said control line.

2. A motor brake according to claim 1, in which said check valve is a check valve that is as a rule disposed in the vicinity of the output side of said injection pump.

3. A motor brake according to claim 1, in which said check valve is disposed at the beginning of said second portion of said control line in the vicinity of said diverter.

4. A motor brake according to claim 1, in which Diesel fuel is used as hydraulic control fluid.

5. In a motor brake of a Diesel engine for a commercial vehicle, including a hydraulic mechanism that during the compression stroke, in the zone of the ignition-upper dead center position, holds the exhaust valve of the engine slightly open, with said hydraulic mechanism being formed by: an actuating cylinder that controls said exhaust valve and includes an actuating piston, a control line, and a transmitter cylinder that has a transmitter piston, the improvement wherein:

an injection pump that is inherent to said engine is itself used as a controlled transmitter cylinder and piston; and said control line is provided with a branch line in which is disposed a valve that is controlled by pressure from an engine cylinder via a pressure line.

6. A motor brake according to claim 5, which includes an additional exhaust brake system, an exhaust valve, that determines the level of said engine cylinder pressure, in other words the control pressure of said valve.

7. A motor brake according to claim 5, which includes an injection nozzle with a vent line; and which includes a discharge line that is connected to said vent line and leads from said valve to a hydraulic fluid reservoir.

* * * * *